US009932752B1

(12) United States Patent
Vila

(10) Patent No.: US 9,932,752 B1
(45) Date of Patent: Apr. 3, 2018

(54) PORTABLE SCREENING ASSEMBLY

(71) Applicant: Gloria Vila, Brookfield, IL (US)

(72) Inventor: Gloria Vila, Brookfield, IL (US)

( * ) Notice: Subject to any disclaimer, the term of this patent is extended or adjusted under 35 U.S.C. 154(b) by 0 days.

(21) Appl. No.: 15/371,611

(22) Filed: Dec. 7, 2016

(51) Int. Cl.
*E04H 15/40* (2006.01)
*A45F 3/02* (2006.01)
*E04H 15/04* (2006.01)

(52) U.S. Cl.
CPC ..... *E04H 15/40* (2013.01); *A45F 3/02* (2013.01); *E04H 15/04* (2013.01)

(58) Field of Classification Search
CPC ..... E04H 15/40; E04H 15/30; E04H 15/48; E04H 15/04; E04H 15/44; E04H 15/425; E04H 15/405; E04H 1/1244; Y10S 135/902; A45F 4/04; A41D 3/08
USPC ... 135/125–126, 128, 117, 119, 902, 90, 95; 220/9.1–9.3, 908; 224/209, 576, 634, 224/656; 4/534, 536; 2/89, 209.11
See application file for complete search history.

(56) References Cited

U.S. PATENT DOCUMENTS 1,599,798 A 9/1926 Stockton
1,804,190 A 5/1931 Wendel
1,990,804 A * 2/1935 Watson ..... E04H 1/1244 135/128
2,344,379 A * 3/1944 Wallin ..... A45F 4/14 2/89
2,376,284 A 5/1945 Sidelmann
2,792,844 A * 5/1957 Clark ..... A45F 4/04 135/117
3,288,157 A 11/1966 Szkolny
5,101,513 A 4/1992 Bowers
5,385,164 A * 1/1995 Sauter ..... A01M 31/02 135/87
5,464,034 A * 11/1995 Kestin ..... A45B 11/04 135/20.2
5,528,849 A * 6/1996 Plinta ..... A01M 31/025 135/126
5,592,961 A 1/1997 Chin
5,611,083 A 3/1997 Arnold
6,088,953 A * 7/2000 Morgan ..... A01G 13/043 135/125
6,431,393 B1 * 8/2002 Stewart ..... B65D 37/00 220/213
7,308,989 B2 * 12/2007 Zheng ..... E04H 15/40 220/565

(Continued)

FOREIGN PATENT DOCUMENTS

WO WO2006048672 11/2006

*Primary Examiner* — Winnie Yip

(57) ABSTRACT

A portable screening assembly for provision of privacy in public spaces includes a pair of rings. A sleeve and a plurality of slats are coupled to and extend between the rings. The sleeve is open ended. The slats are coupled to and coiledly positioned on the sleeve. The slats are elastic rendering them compressible. A plurality of couplers is coupled to the sleeve proximate to a top of the sleeve. The slats, in a resting position, place the sleeve is in an extended configuration to screen a user who is positioned in the sleeve. The slats are configured to be compressed to position the slats and the sleeve in a compressed configuration. The couplers are configured to support the sleeve on shoulders of the user. The couplers also are positionable to mutually couple to retain the slats and the sleeve in the compressed configuration.

9 Claims, 4 Drawing Sheets

(56) References Cited

U.S. PATENT DOCUMENTS

| | | | | |
|---|---|---|---|---|
| 7,815,372 | B2 * | 10/2010 | Stanton | B65F 1/0006 220/9.3 |
| D698,517 | S | 2/2014 | McNamara | |
| 2006/0143773 | A1 * | 7/2006 | Danilova | A41D 7/008 2/88 |
| 2012/0060881 | A1 * | 3/2012 | Ly-Cho | E04H 1/1244 135/121 |
| 2015/0184378 | A1 * | 7/2015 | Silva | E04H 15/44 160/351 |

* cited by examiner

PORTABLE SCREENING ASSEMBLY

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

(2) Description of Related Art Including Information Disclosed Under 37 CFR 1.97 and 1.98

The disclosure and prior art relates to screening assemblies and more particularly pertains to a new screening assembly for provision of privacy in public spaces.

BRIEF SUMMARY OF THE INVENTION

An embodiment of the disclosure meets the needs presented above by generally comprising a pair of rings. A sleeve and a plurality of slats are coupled to and extend between the rings. The sleeve is open ended. The slats are coupled to and coiledly positioned on the sleeve. The slats are elastic rendering them compressible. A plurality of couplers is coupled to the sleeve proximate to a top of the sleeve. The slats, biased to a resting position, place the sleeve is in an extended configuration to screen a user who is positioned in the sleeve. The slats are configured to be compressed to position the slats and the sleeve in a compressed configuration. The couplers are configured to support the sleeve on shoulders of the user. The couplers also are positionable to mutually couple to retain the slats and the sleeve in the compressed configuration.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
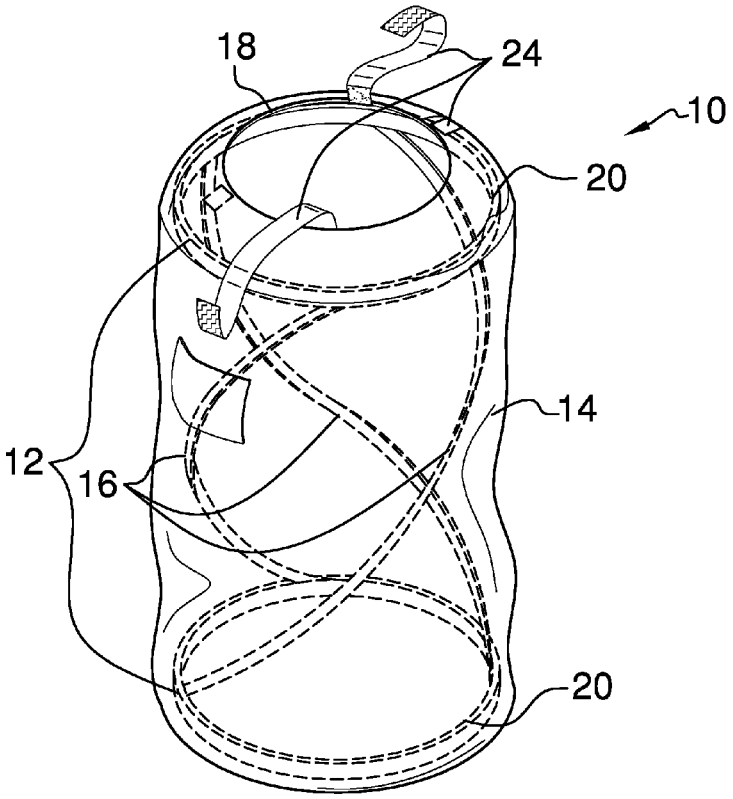
FIG. 1 is an isometric perspective view of a portable screening assembly according to an embodiment of the disclosure.
Figure 2:
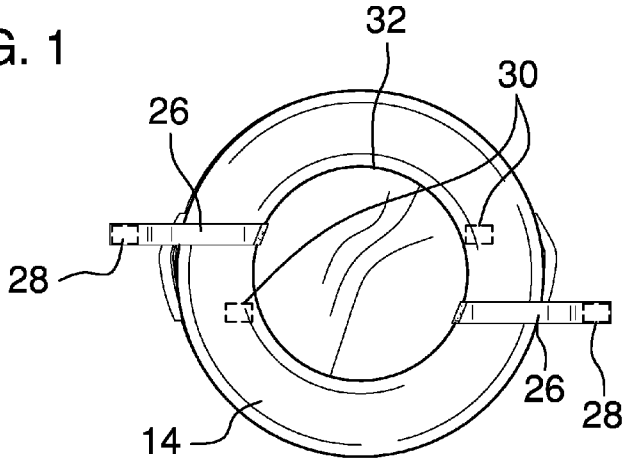
FIG. 2 is a top view of an embodiment of the disclosure.
Figure 3:
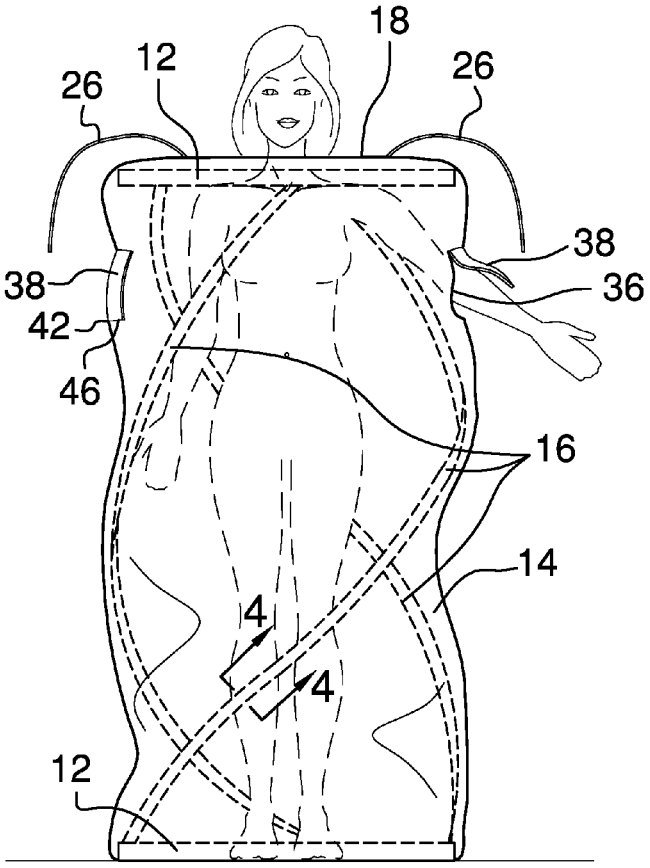
FIG. 3 is an in-use view of an embodiment of the disclosure.
Figure 4:
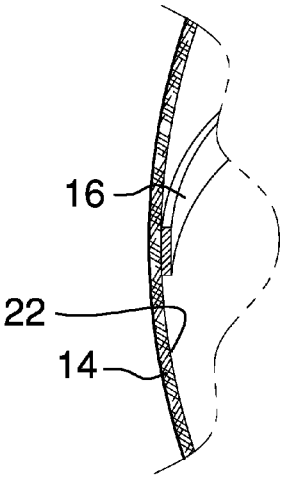
FIG. 4 is a cross-sectional view of an embodiment of the disclosure.
Figure 5:
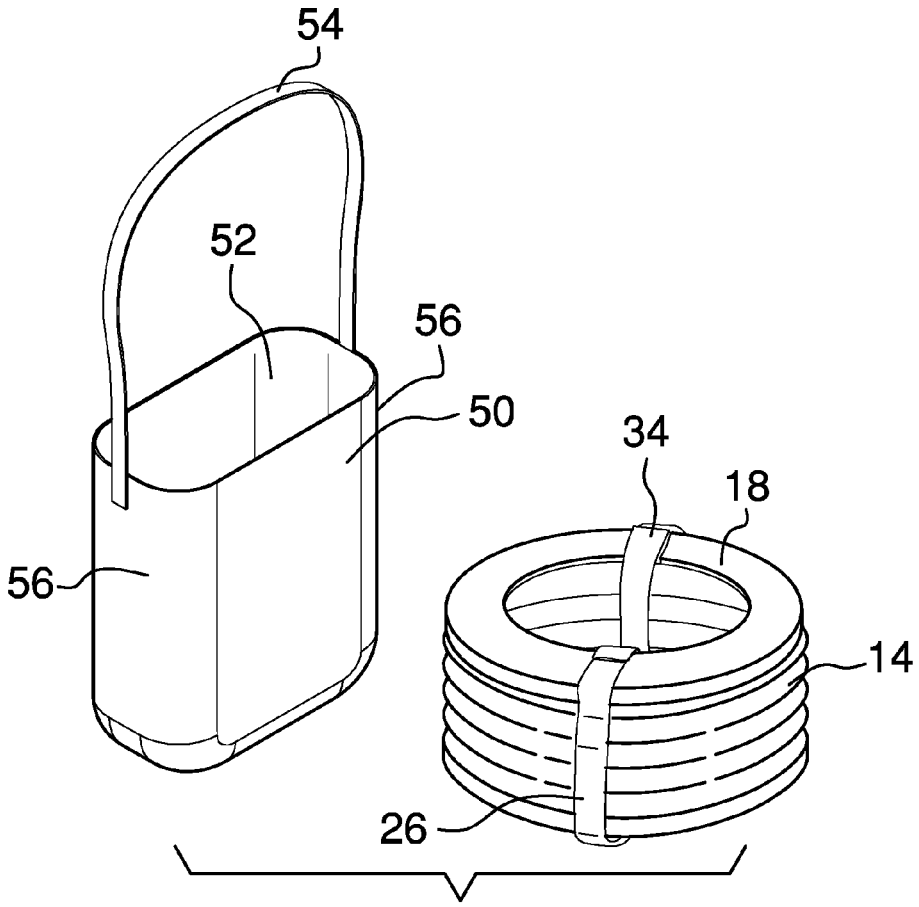
FIG. 5 is a detail view of an embodiment of the disclosure.
Figure 6:
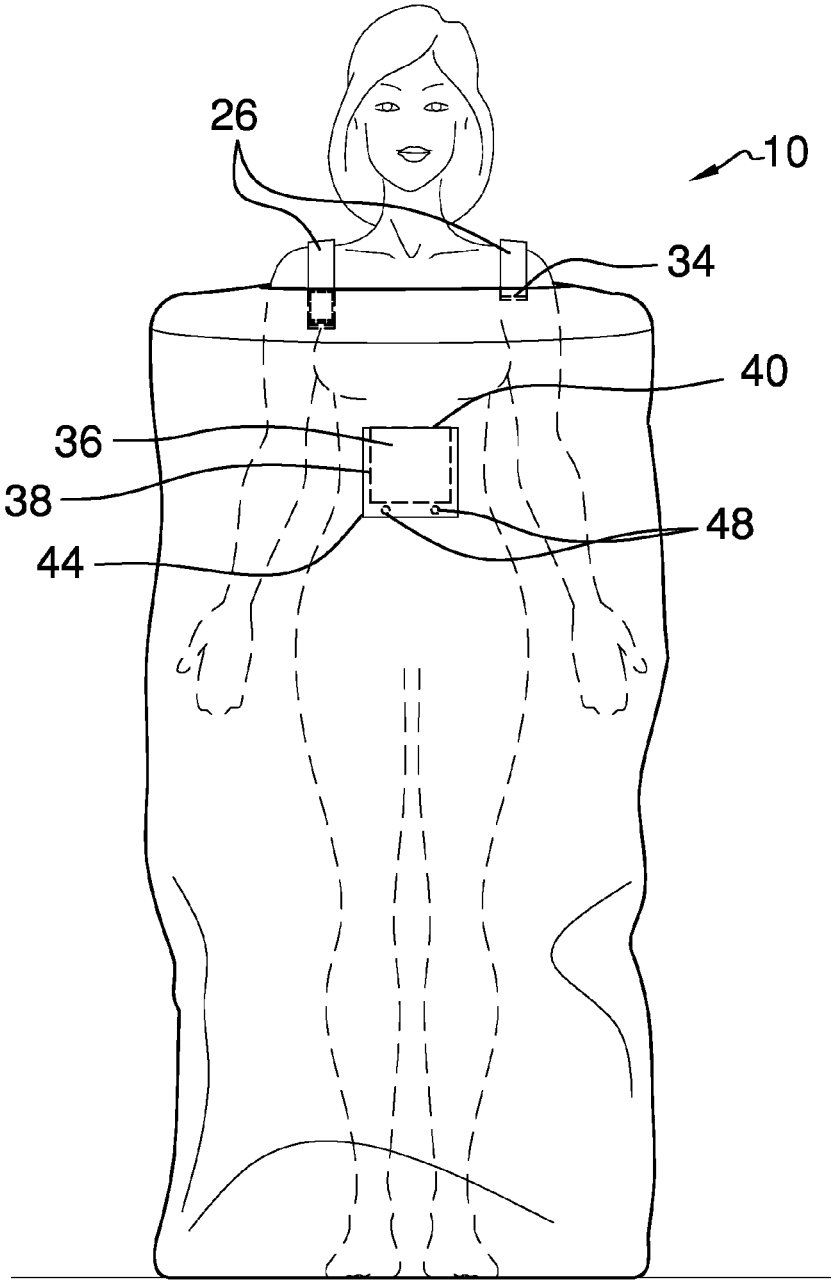
FIG. 6 is an in-use view of an embodiment of the disclosure.

With reference now to the drawings, and in particular to FIGS. 1 through 6 thereof, a new screening assembly embodying the principles and concepts of an embodiment of the disclosure and generally designated by the reference numeral 10 will be described.

As best illustrated in FIGS. 1 through 6, the portable screening assembly 10 generally comprises a pair of rings 12, a sleeve 14 and a plurality of slats 16. The sleeve 14 is coupled to and extends between the rings 12. The sleeve 14 is open ended. The sleeve 14 extends past a respective ring 12 and defines a top 18 of the sleeve 14. The top 18 of the sleeve 14 is circumferentially smaller than the respective ring 12.

The plurality of slats 16 is coupled to and extends between the rings 12. The slats 16 are coupled to and coiledly positioned on the sleeve 14. The slats 16 are elastic such that the slats 16 are compressible. The slats 16 are biased to a resting position wherein the sleeve 14 is in an extended configuration. The sleeve 14 is configured to screen a user who is positioned in the sleeve 14. The slats 16 are configured to be compressed to place the slats 16 and the sleeve 14 in a compressed configuration. In one embodiment, the plurality of slats 16 comprises three slats 16 that are evenly distributed around circumferences 20 of the rings 12. In another embodiment, the slats 16 are positioned on an interior 22 of the sleeve 14. In yet another embodiment, the slats 16 comprises spring steel.

A plurality of couplers 24 is coupled to the sleeve 14 proximate to the top 18 of the sleeve 14. The couplers 24 are configured to support the sleeve 14 on shoulders of the user when the sleeve 14 is in the extended configuration. Additionally, the couplers 24 are positioned to mutually couple to retain the slats 16 and the sleeve 14 in the compressed configuration.

In one embodiment, the plurality of couplers 24 comprises a pair of strips 26, a pair of first connectors 28 and a pair of second connectors 30. The strips 26 are coupled to and extend from the sleeve 14. The strips 26 are substantially opposingly positioned on a perimeter 32 of the top 18. Each first connector 28 is coupled to a respective strip 26 distal from the sleeve 14. The second connectors 30 are coupled to the sleeve 14. The second connectors 30 are substantially opposingly positioned on the perimeter 32 such that each strip 26 is positioned adjacent to a respective second connector 30. Each strip 26 also is opposingly positioned relative to a respective second connector 30. The second connectors 30 are complementary to the first connectors 28. The first connectors 28 are positioned to selectively couple to the second connectors 30 such that the strips 26 are configured to position on the shoulders of the user when the sleeve 14 is in the extended configuration. Additionally, the first connectors 28 are positioned to selectively couple to the second connectors 30 such that the strips 26 are positioned around the pair of rings 12. The strips 26 are positioned to retain the slats 16 and the sleeve 14 in the compressed configuration. In another embodiment, each first connector 28 and a respective second connector 30 comprises a hook and loop fastener 34.

Each of a pair of openings 36 is opposingly positioned through the sleeve 14 proximate to the top 18. The openings 36 are configured to insert arms of the user who is positioned in the sleeve 14. The assembly 10 comprises a pair of panels 38. The panels 38 are complementary to the openings 36. Each panel 38 has an upper edge 40. The upper edge 40 is coupled to the sleeve 14 between the opening 36 and the top 18 of the sleeve 14. The panel 38 is positioned to reversibly cover the opening 36.

Each of a pair of first closures 42 is coupled to a respective panel 38 proximate to a lower edge 44 of the respective panel. Each of a pair of second closures 46 is coupled to the sleeve 14 proximate to a respective opening 36. The second closures 46 are complementary to the first closures 42. The second closures 46 are positioned to reversibly couple to the first closures 42 to couple the panels 38 to the sleeve 14. The openings 36 are selectively openable and closable. In one embodiment, each first closure 42 comprises a pair of magnets 48.

In one embodiment, the assembly 10 comprises bag 50 that is substantially complementary to the slats 16 and the sleeve 14 when the slats 16 and the sleeve 14 are in the compressed configuration. The bag 50 has an upper end 52 that is open. The upper end 52 is positioned to insert the slats 16 and the sleeve 14 when the slats 16 and the sleeve 14 are in the compressed configuration. A strap 54 is coupled to and extends between opposing sides 56 of the bag 50 proximate to the upper end 52. The strap 54 is configured to be grasped by the user to lift the bag 50. The strap 54 also is configured to position over the shoulder to carry the bag 50.

In use, the slats 16 are biased to the resting position wherein the sleeve 14 is in the extended configuration. The sleeve 14 is configured to screen the user who is positioned in the sleeve 14. The first connectors 28 are positioned to selectively couple to the second connectors 30 such that the strips 26 are configured to position on the shoulders of the user when the sleeve 14 is in the extended configuration. The openings 36 are configured to insert the arms of the user who is positioned in the sleeve 14. The second closures 46 are positioned to reversibly couple to the first closures 42 to couple the panels 38 to the sleeve 14 so that the openings 36 are selectively openable and closable. The slats 16 are configured to be compressed to position the slats 16 and the sleeve 14 in the compressed configuration. The first connectors 28 are positioned to selectively couple to the second connectors 30 such that the strips 26 are positioned around the pair of rings 12. The strips 26 are positioned to retain the slats 16 and the sleeve 14 in the compressed configuration.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A portable screening assembly comprising:

a pair of rings;

a sleeve coupled to and extending between said rings, said sleeve being open ended, said sleeve extending past a respective said ring defining said top of said sleeve, said top of said sleeve being circumferentially smaller than said respective said ring;

a plurality of slats coupled to and extending between said rings, said slats being coupled to and coiledly positioned on said sleeve, said slats being elastic such that said slats are compressible;

a plurality of couplers coupled to said sleeve proximate to a top of said sleeve, said plurality of couplers comprising a pair of strips coupled to and extending from said sleeve, said strips being substantially opposingly positioned on a perimeter of said top, a pair of first connectors, each said first connector being coupled to a respective said strip distal from said sleeve, a pair of second connectors coupled to said sleeve, said second connectors being substantially opposingly positioned on said perimeter such that each said strip is positioned adjacent to a respective said second connector and such that each said strip is opposingly positioned to a respective said second connector, said second connectors being complementary to said first connectors, and wherein said first connectors are positioned on said strips such that said first connectors are positioned to selectively couple to said second connectors such that said strips are configured for positioning on the shoulders of the user when said sleeve is in the extended configuration and wherein said first connectors are positioned to selectively couple to said second connectors such that said strips are positioned around said pair of rings such that said strips are positioned for retaining said slats and said sleeve in the compressed configuration;

a pair of openings opposingly positioned through said sleeve proximate to said top such that said openings are configured for inserting arms of the user positioned in said sleeve;

a pair of panels, said panels being complementary to said openings, each said panel having an upper edge, said upper edge being coupled to said sleeve between said opening and said top of said sleeve positioning said panel for reversibly covering said opening;

a bag substantially complementary to said slats and said sleeve when said slats and said sleeve are in the compressed configuration, said bag having an upper end, said upper end being open such that said upper end is positioned for inserting said slats and said sleeve when said slats and said sleeve are in the compressed configuration;

a strap coupled to and extending between opposing sides of said bag proximate to said upper end;

wherein said strap is positioned on said bag such that said strap is configured for grasping by the user for lifting said bag and for positioning over the shoulder for carrying said bag; and wherein said slats are positioned on said rings and said sleeve such that said slats are biased to a resting position wherein said sleeve is in an extended configuration and such that said sleeve is configured for screening a user positioned in said sleeve, wherein said slats are configured for compressing such that said slats and said sleeve are in a compressed configuration; wherein said couplers are positioned on said sleeve such that said couplers are configured for supporting said sleeve on shoulders of the user when said sleeve is in the extended configuration and wherein said couplers are positioned for mutual coupling for retaining said slats and said sleeve in the compressed configuration.

2. The assembly of claim 1, further including said plurality of slats comprising three said slats evenly distributed around circumferences of said rings.

3. The assembly of claim 1, further including said slats being positioned on an interior of said sleeve.

4. The assembly of claim 1, further including said slats comprising spring steel.

5. The assembly of claim 1, further including each said first connector and a respective said second connector comprising a hook and loop fastener.

6. The assembly of claim 1, further comprising:

a pair of first closures, each said first closure being coupled to a respective said panel proximate to a lower edge of said respective said panel;

a pair of second closures, each said second closure being coupled to said sleeve proximate to a respective said opening, said second closures being complementary to said first closures; and wherein said second closures are positioned on said sleeve such that said second closures are positioned for reversibly coupling to said first closures to couple said panels to said sleeve such that said openings are selectively openable and closable.

7. The assembly of claim 6, further including each said first closure comprising a pair of magnets.

8. The assembly of claim 1, further comprising:

a bag substantially complementary to said slats and said sleeve when said slats and said sleeve are in the compressed configuration, said bag having an upper end, said upper end being open such that said upper end is positioned for inserting said slats and said sleeve when said slats and said sleeve are in the compressed configuration;

a strap coupled to and extending between opposing sides of said bag proximate to said upper end; and wherein said strap is positioned on said bag such that said strap is configured for grasping by the user for lifting said bag and for positioning over the shoulder for carrying said bag.

9. A portable screening assembly comprising:

a pair of rings;

a sleeve coupled to and extending between said rings, said sleeve being open ended, said sleeve extending past a respective said ring defining a top of said sleeve, said top of said sleeve being circumferentially smaller than said respective said ring;

a plurality of slats coupled to and extending between said rings, said slats being coupled to and coiledly positioned on said sleeve, said slats being elastic such that said slats are compressible, wherein said slats are positioned on said rings and said sleeve such that said slats are biased to a resting position wherein said sleeve is in an extended configuration and such that said sleeve is configured for screening a user positioned in said sleeve, wherein said slats are configured for compressing such that said slats and said sleeve are in a compressed configuration, said plurality of slats comprising three said slats evenly distributed around circumferences of said rings, said slats being positioned on an interior of said sleeve, said slats comprising spring steel;

a plurality of couplers coupled to said sleeve proximate to said top of said sleeve, wherein said couplers are positioned on said sleeve such that said couplers are configured for supporting said sleeve on shoulders of the user when said sleeve is in the extended configuration and wherein said couplers are positioned for mutual coupling for retaining said slats and said sleeve in a compressed configuration, said plurality of couplers comprising:

a pair of strips coupled to and extending from said sleeve, said strips being substantially opposingly positioned on a perimeter of said top, a pair of first connectors, each said first connector being coupled to a respective said strip distal from said sleeve, a pair of second connectors coupled to said sleeve, said second connectors being substantially opposingly positioned on said perimeter such that each said strip is positioned adjacent to a respective said second connector and such that each said strip is opposingly positioned to a respective said second connector, said second connectors being complementary to said first connectors, each said first connector and a respective said second connector comprising a hook and loop fastener, and wherein said first connectors are positioned on said strips such that said first connectors are positioned to selectively couple to said second connectors such that said strips are configured for positioning on the shoulders of the user when said sleeve is in the extended configuration and wherein said first connectors are positioned to selectively couple to said second connectors such that said strips are positioned around said pair of rings such that said strips are positioned for retaining said slats and said sleeve in the compressed configuration;

a pair of openings opposingly positioned through said sleeve proximate to said top such that said openings are configured for inserting arms of the user positioned in said sleeve;

a pair of panels, said panels being complementary to said openings, each said panel having an upper edge, said upper edge being coupled to said sleeve between said opening and said top of said sleeve positioning said panel for reversibly covering said opening;

a pair of first closures, each said first closure being coupled to a respective said panel proximate to a lower edge of said respective said panel;

a pair of second closures, each said second closure being coupled to said sleeve proximate to a respective said opening, said second closures being complementary to said first closures, wherein said second closures are positioned on said sleeve such that said second closures are positioned for reversibly coupling to said first closures to couple said panels to said sleeve such that said openings are selectively openable and closable, each said first closure comprising a pair of magnets;

a bag substantially complementary to said slats and said sleeve when said slats and said sleeve are in the compressed configuration, said bag having an upper end, said upper end being open such that said upper end is positioned for inserting said slats and said sleeve when said slats and said sleeve are in the compressed configuration;

a strap coupled to and extending between opposing sides of said bag proximate to said upper end, wherein said strap is positioned on said bag such that said strap is configured for grasping by the user for lifting said bag and for positioning over the shoulder for carrying said bag; and wherein said slats are positioned on said rings and said sleeve such that said slats are biased to the resting position wherein said sleeve is in the extended configuration and such that said sleeve is configured for screening the user positioned in said sleeve, wherein said first connectors are positioned on said strips such that said first connectors are positioned to selectively couple to said second connectors such that said strips are configured for positioning on the shoulders of the user when said sleeve is in the extended configuration, such that said openings are configured for inserting the arms of the user positioned in said sleeve, wherein said second closures are positioned on said sleeve such that said second closures are positioned for reversibly coupling to said first closures to couple said panels to said sleeve such that said openings are selectively openable and closable, wherein said slats are configured for compressing such that said slats and said sleeve are in a compressed configuration; and wherein said first connectors are positioned to selectively couple to said second connectors such that said strips are positioned around said pair of rings such that said strips are positioned for retaining said slats and said sleeve in the compressed configuration.

* * * * *